US005834745A

United States Patent [19]

Aoki et al.

[11] Patent Number: 5,834,745

[45] Date of Patent: Nov. 10, 1998

[54] MICROWAVE OVEN WITH NCAP LIQUID CRYSTAL OPERATION DISPLAY PANEL

[75] Inventors: Masayuki Aoki, Inuyama; Kazuo Kitamura, Owariasahi, both of Japan

[73] Assignee: Kabushiki Kaisha Toshiba, Kawasaki, Japan

[21] Appl. No.: 652,154

[22] Filed: May 23, 1996

[30] Foreign Application Priority Data

May 26, 1995 [JP] Japan ..... 7-128306

[51] Int. Cl.[6] ..... H05B 6/68

[52] U.S. Cl. ..... 219/720; 219/506; 219/756; 345/104; 349/16

[58] Field of Search ..... 219/720, 506, 219/685, 756; 345/87, 104, 50; 349/1, 16

[56] References Cited

U.S. PATENT DOCUMENTS

| | | | |
|---|---|---|---|
| 4,435,047 | 3/1984 | Fergason . | |
| 4,447,692 | 5/1984 | Mierzwinski | 219/720 |
| 4,549,054 | 10/1985 | Aoyama | 219/685 |
| 4,568,810 | 2/1986 | Carmean | 219/720 |
| 4,699,470 | 10/1987 | McLaughlin et al. | 349/152 |
| 4,789,858 | 12/1988 | Fergason et al. | 345/104 |
| 5,345,067 | 9/1994 | Ohta et al. | 219/720 |
| 5,616,270 | 4/1997 | Park | 219/720 |

FOREIGN PATENT DOCUMENTS 5-119315 5/1992 Japan .

*Primary Examiner*—Philip H. Leung
*Attorney, Agent, or Firm*—Pillsbury Madison & Sutro LLP

[57] ABSTRACT

A heating apparatus such as a microwave oven includes a magnetron and a heating chamber for accommodating food to be heated by microwaves generated by the magnetron. The heating chamber has a front opening opened and closed by a door. An operation panel is mounted to be adjacent to the door. The operation panel includes a panel section and an operation section mounted on the panel section and has a function of displaying a plurality of pieces of cooking information. The operation section includes a liquid crystal element subsection including a nematic curvilinear aligned phase (NCAP) liquid crystal permitting light to pass through it when voltage is applied to it, an indicia subsection laid on the liquid crystal element subsection and having a plurality of indicias corresponding to the pieces of cooking information, respectively, and a switch subsection including a plurality of switches corresponding to the indicias of the indicia subsection, respectively. A heat-resistant panel frame is mounted between the door and the operation section. The panel frame cuts off heat transmission through a gap between the heating chamber and the door and heat transmission from the door to the liquid crystal element subsection.

36 Claims, 13 Drawing Sheets

MICROWAVE OVEN WITH NCAP LIQUID CRYSTAL OPERATION DISPLAY PANEL

BACKGROUND OF THE INVENTION

1. Field of the Invention

This invention relates to a heating apparatus, such as microwave ovens, with an operation panel having a function of optically displaying cooking information and a function of controlling the presence or absence of the cooking information on a display.

2. Description of the Prior Art

Domestic microwave ovens have been conventionally equipped with an operation panel on which key-input cooking information is displayed. A display means disposed in the operation panel includes a combination of fluorescent character display tubes or a combination of light-emitting diodes (LED). These tubes or LEDs are designed to display a plurality of pieces of key-input cooking information. Another display means comprises a plurality of lamps whose front faces are covered by a film on which indicias indicative of pieces of cooking information are printed. The indicias are displayed when the corresponding lamps are turned on. The above-described display means have respective features and are employed in the microwave ovens so that the best use of respective features are made.

In the above-described microwave ovens, a lamp or LED is turned on so that a key to be subsequently operated is specified by means of optical displaying for the purpose of prompting a user to operate the key. For this purpose, a key is illuminated from behind thereof by a lamp, or LEDs provided in the vicinity of the respective keys are turned on.

However, the thickness of a whole operation panel is increased in the arrangement in which the key is illuminated from behind thereof by the lamp. Furthermore, in the arrangement in which LEDs are provided in the vicinity of the respective keys, a surface area of the panel is increased and it is difficult for the user to visually recognize which of the keys is being prompted. These drawbacks lower the usability of the microwave ovens.

The prior art has provided touch switches in which the user only touches the surface of a display panel with his or her finger to operate a switch. However, since a manufacturing cost of the touch switch is high, the touch switch cannot be employed in a heating apparatus which demands a low manufacturing cost. In this regard, the prior art has proposed an arrangement wherein a display panel be laid on operation switches so that operation of the display panel actuates the switches. However, this arrangement cannot be achieved since no display panel having such elasticity as to allow displacement in operation has been provided. More specifically, since the fluorescent character display tube cannot provide elasticity in its structure, it cannot be laid on the operation switches. On the other hand, a liquid crystal panel can provide elasticity. However, deformation of the panel due to operation thereof lowers the characteristics of liquid crystal. Furthermore, the liquid crystal panel has a small angle of visibility and accordingly provides low visibility.

SUMMARY OF THE INVENTION

Therefore, an object of the present invention is to provide a heating apparatus which has an operation panel having both a displaying function and a switch operating function by utilizing the elasticity of a liquid crystal element comprising a nematic curvilinear aligned phase liquid crystal and providing a high level of visibility. Accordingly, the operation panel is cost effective.

The present invention provides a heating apparatus comprising heating means, a heating chamber provided for accommodating food to be heated by the heating means and having a front opening, a door for closing and opening the front opening of the heating chamber, an operation panel including a panel section disposed to be adjacent to the door and an operation section provided on the panel section and having a function of displaying a plurality of pieces of cooking information, and a heat shield provided between the door and the operation section for restricting heat transfer from the door to the operation section of the operation panel. The operation section includes a liquid crystal element subsection comprising a nematic curvilinear aligned phase (NCAP) liquid crystal permitting light to pass therethrough when a voltage is applied thereto, an indicia subsection disposed to be laid on the liquid crystal element subsection and having a plurality of indicias corresponding to the pieces of cooking information respectively, and a switch subsection including a plurality of switches provided to correspond to the indicias of the indicia subsection respectively. U.S. Pat. No. 4,435,047 granted to James L. Fergason on Mar. 6, 1984 discloses an NCAP liquid crystal in detail.

Since the liquid crystal element subsection composed of the NCAP liquid crystal has elasticity, the construction of the switch subsection can be simplified by utilizing the liquid crystal element subsection as an operating displacement transfer member. Furthermore, since heat transmission from the heating chamber to the operation panel can be prevented by the heat shield, deterioration of the liquid crystal element by heat, which deterioration lowers its displaying function, can be prevented. Additionally, a prompting function can be achieved at a low cost in the above-described heating apparatus.

The operation section may project ahead of the front opening of the heating chamber and have a front surface approximately planar with a front surface of the door. Consequently, the displaying function of the operation section can be further prevented from being lowered due to heat from the heating chamber, and the design of the apparatus can be improved.

The liquid crystal element subsection of the operation section may be composed into the form of a single plate extending over substantially an entire surface of the panel section. Consequently, the operation panel can be cleaned readily, and the waterproofness of the operation panel can be improved.

The liquid crystal element subsection of the operation section may be composed into the form of a panel having substantially no holes and a cut face in an outer peripheral end face thereof. Consequently, penetration of water through an end face of the liquid crystal element subsection can be prevented.

The operation section may include a protrusion protruding from a front face thereof, and the liquid crystal element subsection of the operation section may have a hole encompassing the protrusion and have an inner peripheral end face waterproofed. Consequently, water can be reliably prevented from penetrating through the inner peripheral end face of the hole.

The indicia subsection of the operation section may comprise a first element reflecting light having passed through the liquid crystal element. Alternatively, the indicia subsection of the operation section may comprise a second element permitting light to pass through the liquid crystal element. Alternatively, the indicia subsection of the operation section may comprise the first and second elements. Consequently, the indicias indicative of the pieces of cooking information can be properly displayed by the light reflecting or transmitting element or by selected one of them.

The heating apparatus may further comprise an oven light for illuminating the interior of the heating chamber, and the oven light may be adapted to also illuminate the light transmitting elements composing the indicia subsection of the operation section. Consequently, the visibility of the indicia subsection can be improved.

The area of the operation section can be effectively used when the switch subsection of the operation section has a plurality of switches all of which correspond to the indicias of the indicia subsection, respectively.

The liquid crystal element subsection of the operation section may include a plurality of segments corresponding to the indicias of the indicia subsection, respectively, and may be controlled so that all the segments thereof corresponding to the respective indicias of the indicia subsection are each turned to a light transmissible state when electric power is supplied to the apparatus. Consequently, a user can be informed of all the pieces of cooking information prior to operation.

The liquid crystal element subsection of the operation section may be further controlled so that one or more segments thereof corresponding to the acceptable switches of the switch subsection are each turned to a light transmissible state after one of the other switches of the switch subsection has been operated. Consequently, misoperation by the user can be prevented and the operation keys can be properly operated in the use of the microwave oven without user's embarrassment. In this case, too, the liquid crystal element subsection of the operation section may be controlled so that all the segments thereof corresponding to the indicias of the indicia subsection are turned to a light transmissible state when electric power is supplied to the apparatus.

The switch subsection of the operation section may comprise a membrane switch including films and electrodes disposed between the films. Consequently, the switch subsection can be rendered thinner. The structure of the switch subsection can be simplified when the membrane switch is composed to include a part of the liquid crystal element subsection as components thereof.

The membrane switch may further include contacts each formed of a transparent material. Each film of the membrane switch may be formed of a transparent material. The membrane switch may be disposed at the front surface side of the liquid crystal element section. An ultraviolet (UV) barrier required for the liquid crystal element subsection can be eliminated.

The switch subsection of the operation section may comprise a plurality of tact switches. The switch subsection of the operation section may further comprise a plurality of actuating members disposed between the liquid crystal element subsection of the operation section and the tact switches. Each actuating member may be displaced in response to depression applied to the liquid crystal element subsection, thereby actuating the corresponding tact switch. Each actuating member may have a first contact portion brought into contact with the liquid crystal element subsection and a second contact portion brought into contact with the corresponding tact switch. The first contact portion of each actuating member may have a larger area than the second contact portion thereof. Consequently, each tact switch can be reliably operated in response to operation of the corresponding indicia subsection.

The first contact portion of each actuating member may have a rounded peripheral edge. The liquid crystal element subsection can be prevented from being damaged even when depressed to be violently abutted against the peripheral edge of the operation section.

The operation section may include a support member supporting the liquid crystal element subsection and having a plurality of through holes through which the actuating members are disposed respectively, each through hole having a rounded peripheral edge at a side thereof in contact with the liquid crystal element subsection. Consequently, the liquid crystal element subsection can be prevented from being damaged even when depressed to be violently abutted against the peripheral edge of the through hole of the support member.

The indicias of the indicia subsection of the operation section may be formed on the first contact portions of the actuating members, respectively, instead of on the liquid crystal element subsection.

The heating means may comprise a magnetron for supplying microwaves to the heating chamber, and a radio wave shield may be provided between the operation section and the door. Consequently, even if the microwave energy should leak through a gap between the heating chamber and the door, the liquid crystal element subsection of the operation section could be prevented from being adversely affected into malfunction.

The liquid crystal element subsection of the operation section is preferably disposed on the panel section so as to extend in a range of two-thirds of the height of the panel section from the lower end thereof. Furthermore, the liquid crystal element subsection of the operation section is preferably disposed on the panel section so as to extend in a range of two-thirds of the width of the panel section from an end of the apparatus opposite the heating chamber. Consequently, the temperature of the liquid crystal element subsection can be prevented from being increased to thereby lower its displaying function even when the temperature of an upper portion of the panel section or of a portion of the panel section adjacent to the heating chamber is increased.

The liquid crystal element subsection of the operation section may be disposed on the panel section so that a distance between an end thereof at a side of the heating chamber and an end of the panel section at the heating chamber side is longer than a distance between an end thereof at a side opposite the heating chamber and an end of the panel section at the side opposite the heating chamber. In this case, too, the temperature of the liquid crystal element subsection can be prevented from being increased to thereby lower its displaying function even when the temperature of the portion of the panel section adjacent to the heating chamber is increased.

The panel section may include a display element disposed on an upper portion thereof and the liquid crystal element subsection may be disposed on the panel section to be located lower than the display element. Thus, the upper portion of the panel section can be effectively used.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
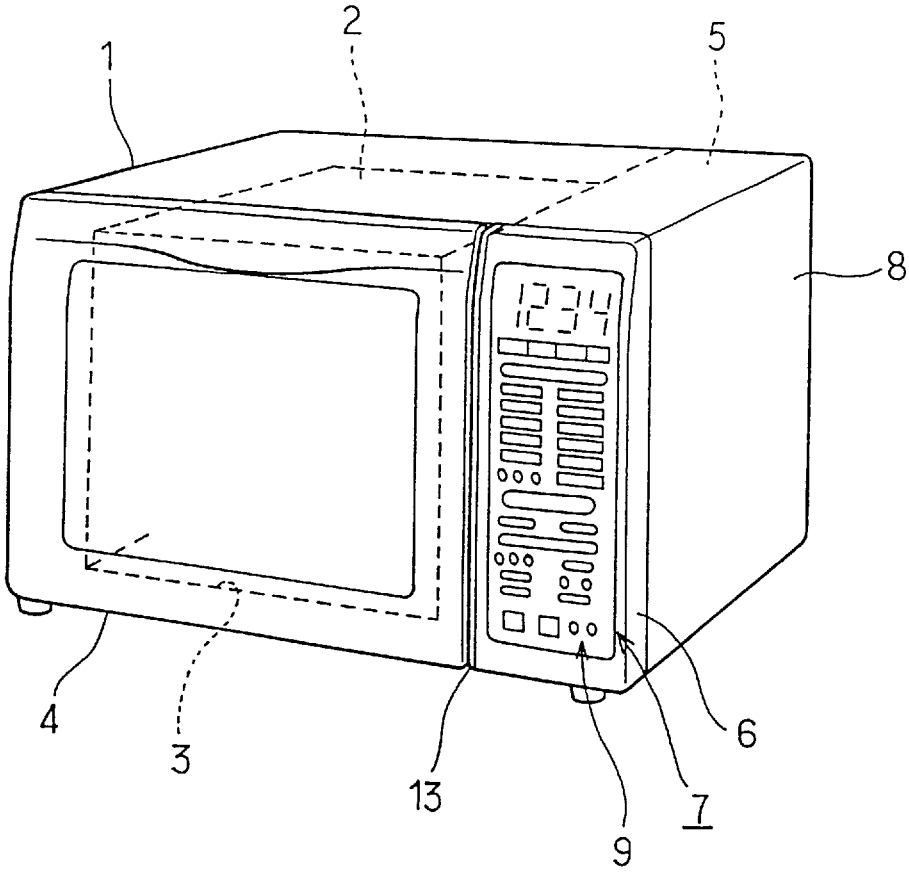
FIG. 1 is a perspective view of a microwave oven of a first embodiment in accordance with the present invention.
Figure 2:
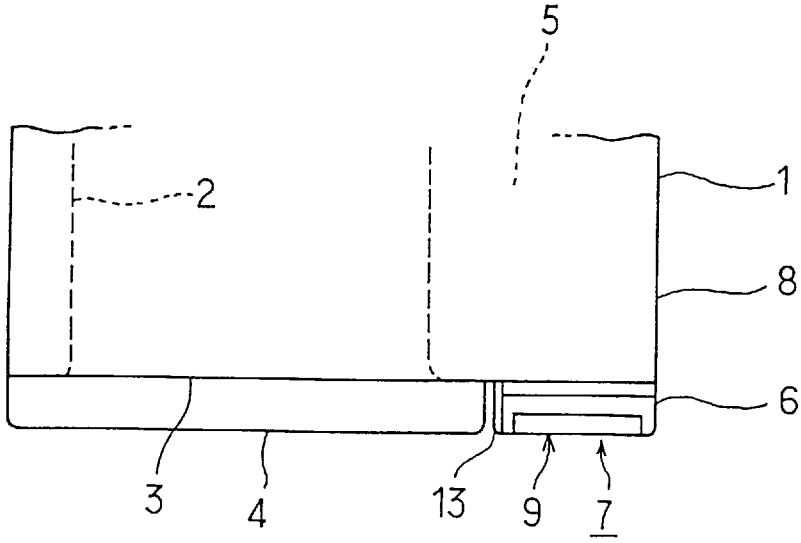
FIG. 2 is a partial top plan view of the microwave oven.

A first embodiment of the present invention will be described with reference to FIGS. 1 to 7. The invention is applied to a microwave oven with oven cooking and grilling functions in the embodiment. Referring to FIGS. 1 and 2, a microwave oven body 1 includes a heating chamber 2 having a front opening 3 which is closed and opened by a door 4. The body 1 further includes a component chamber 5 adjacent to the heating chamber 2. An operation panel is provided at the right-hand side of the door 4, as is viewed in FIG. 1. The operation panel comprises a panel section 6 mounted on a front face of the component chamber 5 and an operation section 7 provided on a front face of the panel 6. A casing 8 is attached to the body 1 so as to enclose the heating chamber 2 and the component chamber 5 therein.

Figure 3:
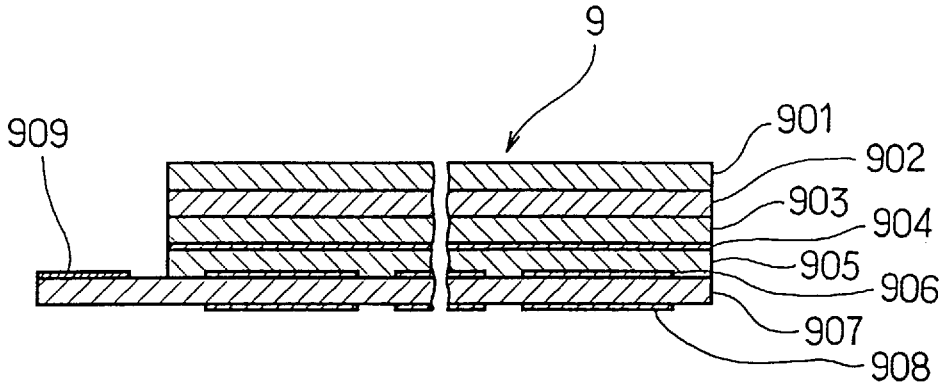
FIG. 3 is a schematic sectional view of a liquid crystal element subsection employed in the microwave oven.
Figure 4:
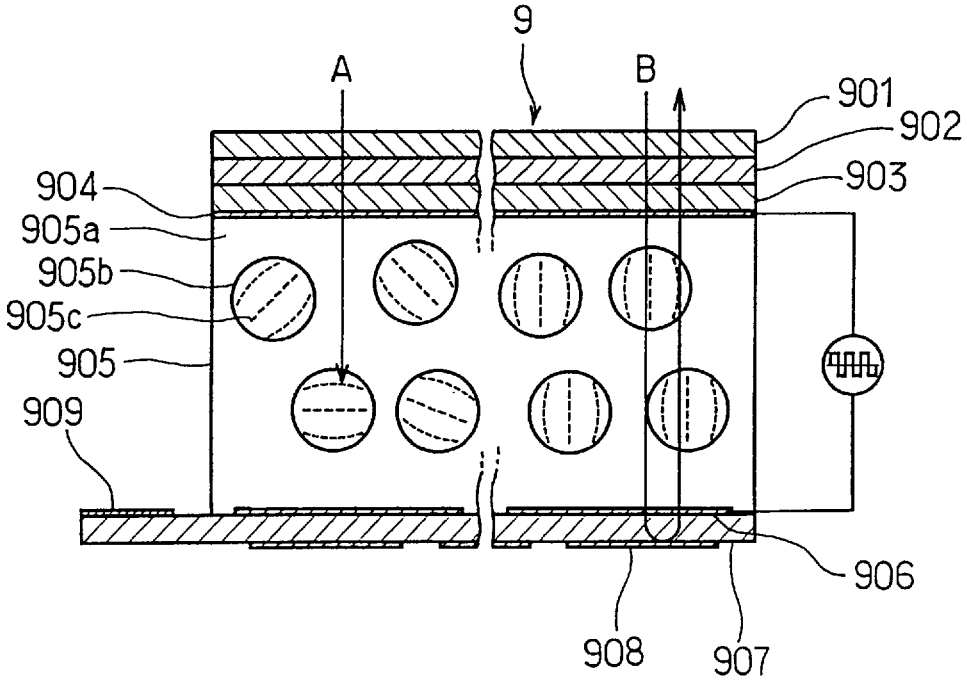
FIG. 4 is a schematic sectional view of the liquid crystal element subsection with an NCAP liquid crystal in FIG. 3 being enlarged.

The operation section 7 of the operation panel comprises a liquid crystal element subsection 9 provided on the front face thereof. Referring to FIGS. 3 and 4, the liquid crystal element subsection 9 comprises a paint mask 901, an ultraviolet (UV) barrier 902, a common transparent electrode film 903, a common transparent electrode 904, a nematic curvilinear aligned phase (NCAP) liquid crystal element 905, a segmented transparent electrode 906, a segmented electrode film 907, and a plurality of reflecting members 908 sequentially from the front face side thereof. A lead portion 909 from which lead wires are to be extended is provided on the segmented electrode film 907.

The paint mask 901 is a film on which indicias other than those indicative of pieces of key-input cooking information which will be described later are printed. These indicias printed on the paint mask 901 can be viewed at the front face side of the liquid crystal element subsection 9 whether the NCAP liquid crystal element 905 is turned on or off. The UV barrier 902 protects a dye encapsulated in each cell to dye the NCAP liquid crystal in black. The common transparent electrode 904 for activating the NCAP liquid crystal in the cells is printed on the side of the common transparent electrode film 903 at the NCAP liquid crystal element side. The electrode 904 is common to all the segments of the segmented transparent electrode 906. The NCAP liquid crystal will be described in detail later. The segmented transparent electrode 906 is printed on one side of the segmented electrode film 907 and the reflecting members 908 are provided on the other side thereof. A plurality of indicias indicative of a plurality of pieces of key-input cooking information are printed on the respective reflecting members 908 in the form of characters or figures.

The NCAP liquid crystal element 905 will now be described with reference to FIG. 4. A rubber 905*a* with elasticity has small spherical cells 905*b* disposed therein. An NCAP liquid crystal 905*c* is encapsulated in each cell 905*b*. Since the NCAP liquid crystal 905*c* is itself transparent, the crystal is dyed in black for the purpose of control of light transmission by the NCAP liquid crystal 905*c*. Particles of the NCAP liquid crystal 905*c* is slender and are aligned in the curvilinear state toward two opposite poles in each spherical cell 905*b*, which state is referred to as "nematic curvilinear aligned state phase."

The liquid crystal is oriented in random directions in each cell 905*b* when no voltage is applied to the NCAP liquid crystal element 905. In this state, light incident from the surface of element 905 is intercepted by the dye in each cell 905*b*, whereupon almost no light is reflected on each of the reflecting members 908, as is shown by arrow A in FIG. 4. Consequently, no indicias or pieces of cooking information printed on the reflecting members 908 can be viewed from the front side of the liquid crystal element subsection 9.

On the other hand, an electric field is established around one liquid crystal segment located between the electrodes 904 and 906 in the liquid crystal element 905 when voltage is applied between the electrodes 904 and 906. In this state, the NCAP liquid crystal 905*c* in the cell 905*b* located in the segment is aligned in the direction of the electric field. Consequently, light incident from the surface of the element 905 is reflected on the reflecting member 908 to be radiated from the surface of the element section 9, as is shown by arrow B in FIG. 4. Thus, the indicia or the key-input cooking information printed on the reflecting member 908 can be viewed at the surface side of the liquid crystal element subsection 9.

Figure 5:
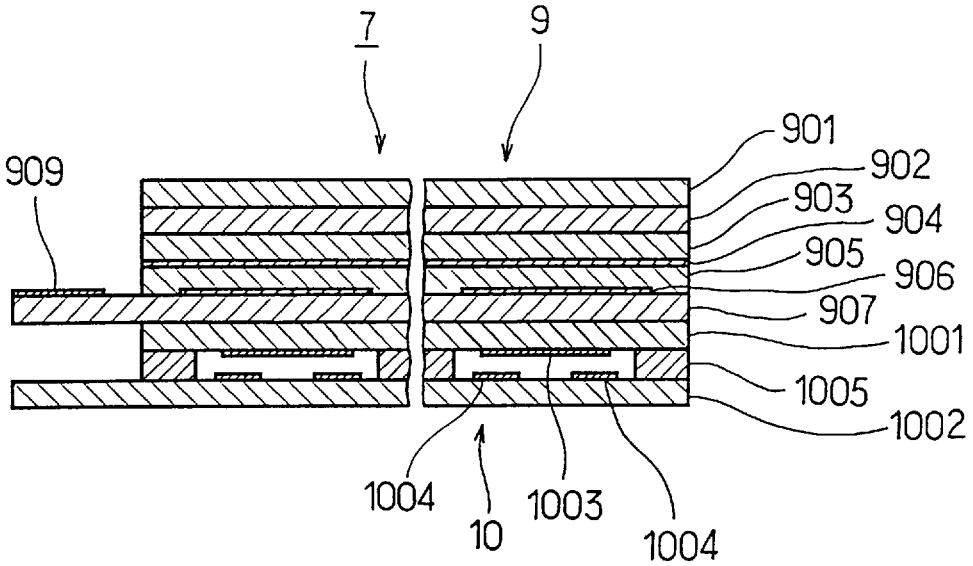
FIG. 5 is a schematic sectional view of an operation section as shown in FIG. 1.

Since the liquid crystal element subsection 9 using the NCAP liquid crystal element 905 has elasticity, an operation section 7 with a high level of usability can be manufactured when the liquid crystal element subsection 9 is laid on a switch section. FIG. 5 illustrates an arrangement in which a membrane switch 10 serving as the switch section is integrally provided on the backside of the above-described liquid crystal element subsection 9. The membrane switch 10 comprises two films 1001 and 1002 opposite to each other, membrane electrodes 1003 provided on the film 1001, and short pads 1004 which are provided on the film 1002 to serve as contacts. Insulating sheets are interposed between the films 1001 and 1002. When the film 1001 is not depressed from the front face side (the upper side in FIG. 5), the membrane electrode 1003 is separated from the short pads 1004 serving as contacts such that the membrane switch 10 is turned off.

An indicia subsection (not shown) serving as the reflecting members 908 in FIG. 3 is printed on the surface or upper face of the film 1001 composing the membrane switch 10, as viewed in FIG. 5. The indicia subsection includes a plurality of indicias indicative of pieces of key-input cooking information of the membrane switch 10. The segments of the segmented transparent electrode 906 of the liquid crystal element subsection 9 correspond to the indicias of the indicia subsection respectively. Accordingly, when voltage is applied between the common transparent electrode 904 and one segment of the segmented transparent electrode 906, light is permitted to pass through the NCAP liquid crystal element 905 located between these electrodes, whereupon the corresponding indicia of the indicia subsection on the film 1001 can be viewed.

Figure 6:
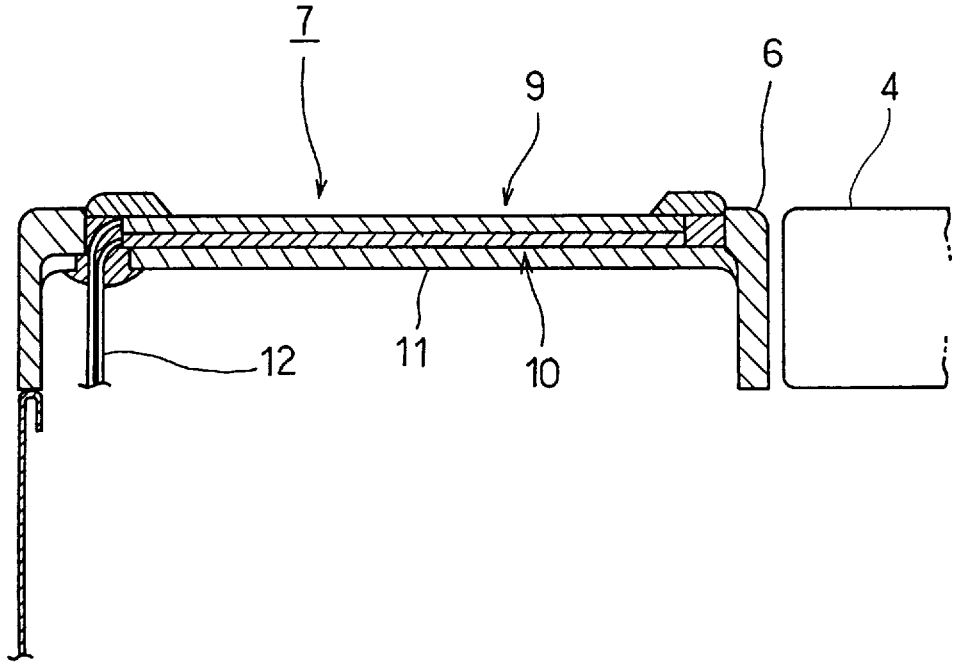
FIG. 6 is a schematic sectional view of the operation section attached to a panel section.

FIG. 6 illustrates the above-described operation section 7 mounted on the microwave oven body 1. A support member 11 is secured to a panel frame 6. The operation section 7 is attached to the front face of the support member 11. In this case, the outer peripheral end faces of the liquid crystal element subsection 9 and the membrane switch 10 both composing the operation section 7 are exposed. Accordingly, the liquid crystal element subsection 9 and the membrane switch 10 need to be waterproofed against water penetration through the exposed end faces thereof. For this purpose, the end faces of the liquid crystal element subsection 9 and the membrane switch 10 are sealed by a silicon resin or the like. This sealing is a simple and effective waterproofing means and provides the operation section 7 with high reliability. Furthermore, all lead wires 12 of the operation section 7 are extended out of its end opposite to the heating chamber 2, whereby the lead wires 12 are prevented from being adversely affected by heat transmitted from the heating chamber 2.

The liquid crystal element subsection 9 comprising the NCAP liquid crystal element 905 is susceptible to heat such that the displaying function thereof is disadvantageously lowered. More specifically, heat deteriorates the UV barrier 902 protecting the dyes in the cells 905*b*, thereby lowering the ultraviolet-ray intercepting function thereof. When the ultraviolet ray cannot be intercepted by the UV barrier 902, the dyes in the cells 905*b* of the NCAP liquid crystal element 905 is decomposed by the ultraviolet ray such that the light absorptivity thereof is lowered. If this should occur, the NCAP liquid crystal element 905 would permit light to pass therethrough even when no voltage is applied thereto, whereupon the indicias or the pieces of cooking information printed on the reflecting member 908 could normally be viewed. In this state, the liquid crystal element subsection 9 would not perform its displaying function.

On the other hand, although the door 4 is adapted to closely contact with the peripheral edge of the front opening 3, a hot air in the heating chamber 2 leaks through a slight gap therebetween to raise the temperature of the operation section 7. Furthermore, heat transfer from the door 4 to the operation section 7 raises the temperature thereof. In these cases, too, the liquid crystal element section 9 would no longer perform its displaying function.

The liquid crystal element subsection 9 of the operation section 7 is protected against heat from the heating chamber 2 in the following manner. Referring to FIGS. 1 and 2, the side face of the operation section 7 adjacent to the door 4 is covered by a panel frame 13 of a heat resistant plastic or metal serving as a heat shield. The panel frame 13 intercept heat radiation from the heating chamber 2 to the operation section 7 and heat transfer from the door 4 to the operation section 7. Consequently, the temperature of the liquid crystal element section 9 of the operation section 7 can be prevented from being increased to such a level that the displaying function thereof cannot be maintained.

Furthermore, the operation section 7 is disposed to project ahead of the front opening 3 of the heating chamber 2 and has a front surface approximately planar with a front surface of the door 4. Consequently, the door 4 and the projection of the operation section 7 restricts heat transfer. Thus, the heat intercepting effect for the operation section 7 can be increased and the planarity of the door 4 with the operation section 7 improves the design of the microwave oven. Moreover, the material of the paint mask 901 composing the surface of the liquid crystal element section 9 is selected to have flame resistance at or above the UL flame resistance grade 94-V0. Consequently, parts in the component chamber 5 can be protected against heat transferred from the front face side of the operation section 7. Thus, the members or parts enclosed in the casing 1 can be prevented from burning as the result of a fire caught from, for example, a gas burning appliance even when the same is located near the microwave oven.

The end face of the liquid crystal element subsection 9 needs to be waterproofed as described above. Accordingly, the liquid crystal element subsection 9 is formed into the shape of a single plate without being divided into a plurality of portions. Consequently, the number of portions waterproofed can be decreased Furthermore, from the standpoint that the number of portions waterproofed is decreased, it is desirable that the liquid crystal element subsection 9 have no holes except for those on the outer peripheral end face thereof.

Figure 7:
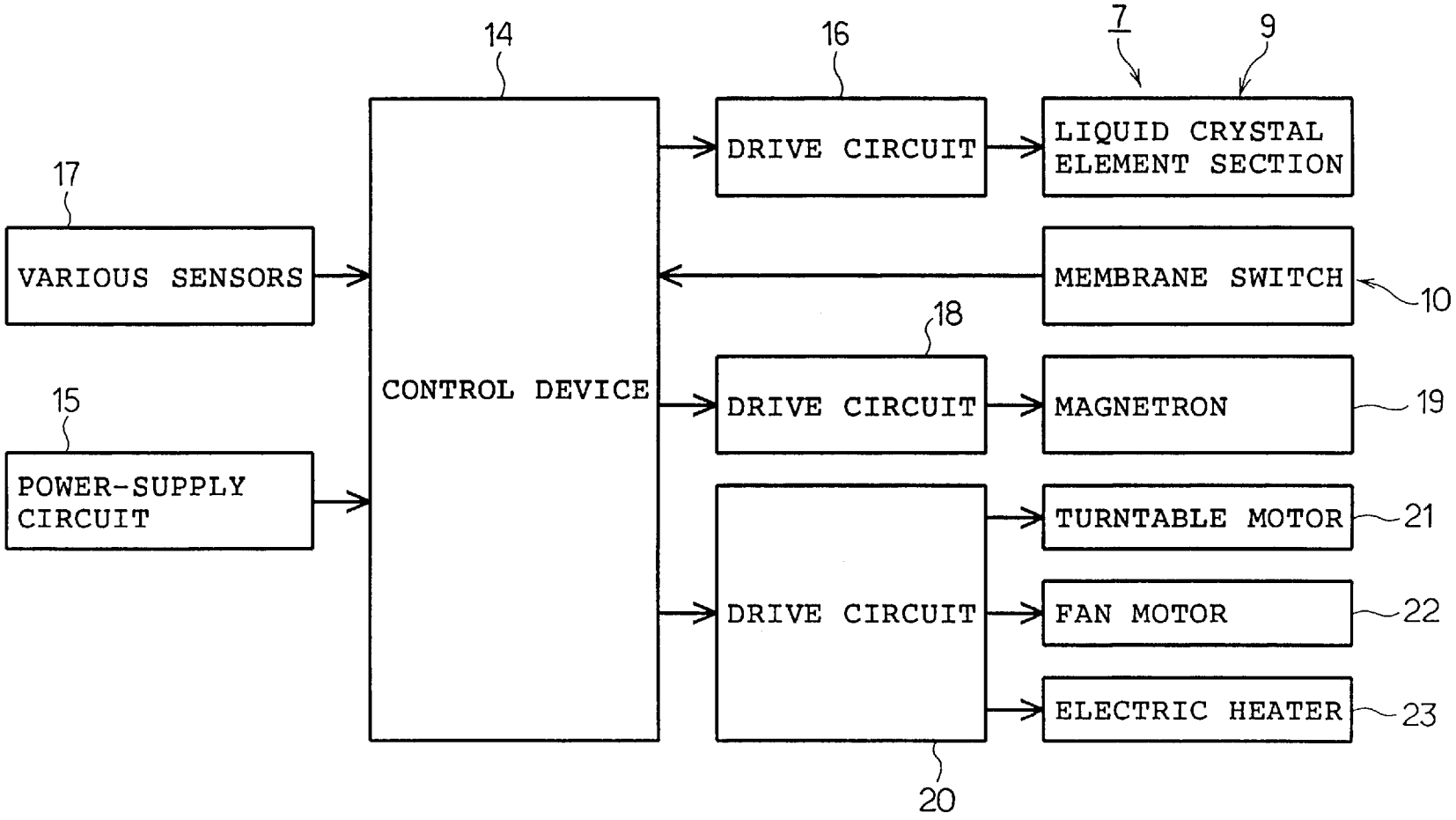
FIG. 7 is a block diagram showing an electrical arrangement of the microwave oven.

FIG. 7 illustrates an electrical arrangement of the microwave oven. A control device 14 initiates a cooking condition setting operation when electric power is supplied from a power-supply circuit 15 thereto. More specifically, voltage is applied through a drive circuit 16 to the liquid crystal element subsection 9 so that the same is changed to a light transmissible state, whereby selected indicias of the indicia subsection on the film 1001 is rendered visible. Subsequently, based on an ON signal from the membrane switch 10, the control device 14 selects a cooking course and executes heating in accordance with the set cooking course when the ON signal is input thereto from one of the segments of the membrane switch 10 serving as a start switch.

The cooking conditions include an automatic cooking mode and a manual cooking mode. The control device 14 executes the heating operation on the basis of the results of detection of various sensors 17 when the automatic cooking mode has been selected. The control device 14 executes the heating operation on the basis of the cooking conditions set when the manual cooking mode has been selected.

Furthermore, the control device 14 drives a magnetron 19 serving as heating means via a drive circuit 18 in accordance with the set cooking course. The control device 14 further energizes via a drive circuit 20 a turntable motor 21, a fan motor 22 and an electric heater 23 also serving as another heating means.

According to the above-described construction, the side face of the operation section 7 at the heating chamber side is covered by the panel frame 13 or heat shield so that heat transfer from the heating chamber 2 and the door 4 to the operation section 7 is prevented. Consequently, the liquid crystal element subsection 9 comprising the NCAP liquid crystal element 905 can be used in a display device of the microwave oven even though the NCAP liquid crystal element contains the substance which is easily deteriorated by heat. Accordingly, the membrane switch 10 can be provided on the backside of the liquid crystal element subsection 9 to be operable via the latter. Thus, the operation panel can be rendered small and thin as compared with that employing the fluorescent character display tubes. Furthermore, the above-described operation panel is not deteriorated with respect to the characteristics of the liquid crystal and the visibility as compared with conventional ordinary liquid crystal panels.

Figure 8:
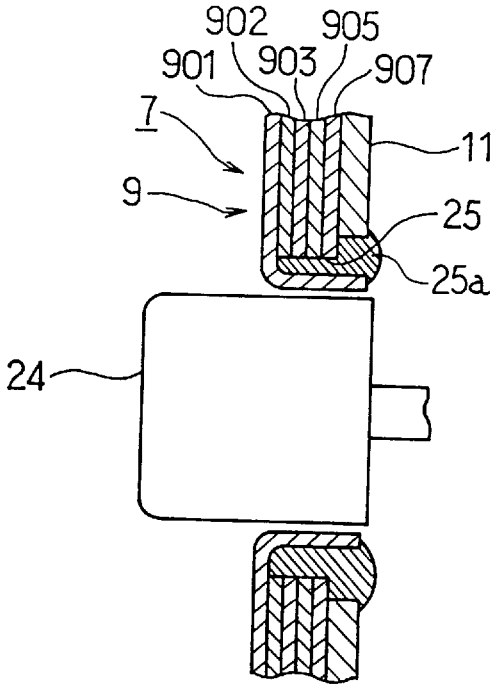
FIG. 8 is a sectional view of an operation section of a microwave oven of a second embodiment in accordance with the present invention.

FIG. 8 illustrates a second embodiment of the present invention. Identical or similar parts are labeled by the same reference numerals in the second embodiment as those in the first embodiment. The differences between the first and second embodiments will be described. The operation section 7 includes an operation knob 24 projecting ahead thereof and serving as a protrusion. The operation knob 24 is operated so that a cooking menu, a heating time and so on are set in accordance with an amount of operation thereof. The operation section 7 further includes a hole or notch 25 formed therein. The operation knob 24 is provided to extend through the hole 25.

Portions of the peripheral edges of the respective liquid crystal element subsection 9 and the membrane switch 10 defining the hole 25 are exposed as end faces when the hole 25 is formed in the operation section 7. The liquid crystal element subsection 9 and the membrane switch 10 are waterproofed in the following manner. A portion of the paint mask 901 projecting into the hole 25 is bent toward the inner circumference of the hole 25 with a predetermined gap therebetween. A space defined between the bent portion of the paint mask 901 and the inner circumferential face of the hole 25 is filled with a sealing member such as a silicon resin 25*a*. Consequently, the reliability of the operation section 7 regarding the deterioration resistance can be improved together with an improvement of its design even when the hole 25 is formed in the operation section 7 to correspond to the operation knob 24. The above-described construction should not be limited to the hole 25 and may be applied to various types of operation keys which are mounted to extend through the operation section 7.

Figure 9:
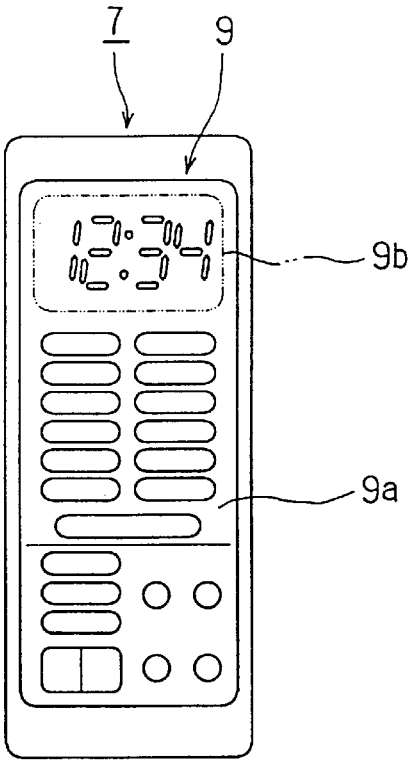
FIG. 9 is a front view of an operation section of a microwave oven of a third embodiment in accordance with the present invention.
Figure 10:
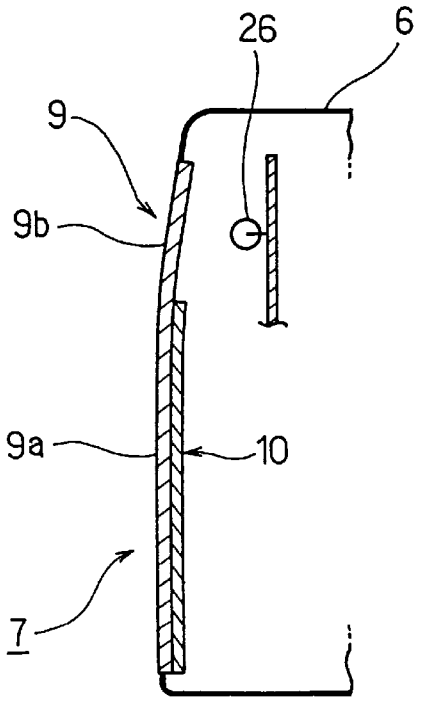
FIG. 10 is a sectional view of a panel section of the operation panel with a backlight provided.

FIGS. 9 and 10 illustrate a third embodiment of the present invention. Identical or similar parts are labeled by the same reference numerals in the third embodiment as those in the first embodiment. The differences between the first and third embodiments will be described. Since the liquid crystal element subsection 9 is not a self-light-emitting display device, a lamp 26 serving as a backlight is effectively provided behind the operation section 7 to illuminate the same. In this regard, the visibility of the indicia subsection need not be improved depending upon some indicias or pieces of key-input cooking information displayed thereon. Accordingly, the indicia subsection is divided into a reflecting element 9*a* reflecting light incident from the front surface side thereof and a transmitting element 9*b* permitting light from the rear side thereof to pass therethrough. A portion of the indicia subsection corresponding to the transmitting element 9*b* is formed of a light transmitting material, and the lamp 26 is disposed behind the transmitting element 9*b*. Consequently, the visibility of the portion of the indicia subsection corresponding to the transmitting element 9*b* can be improved. The transmitting element 9*b* is provided with a transparent film with indicias or pieces of cooking information printed thereon, instead of the reflecting member 908.

A light emitting diode (LED), an electrochromic (EL) panel and the like may serve as the backlight, instead of the lamp 26. Furthermore, the microwave oven is normally provided with an oven light illuminating the interior of the heating chamber. The construction of the microwave oven can be simplified when the oven light also serves as a backlight.

Figure 11:
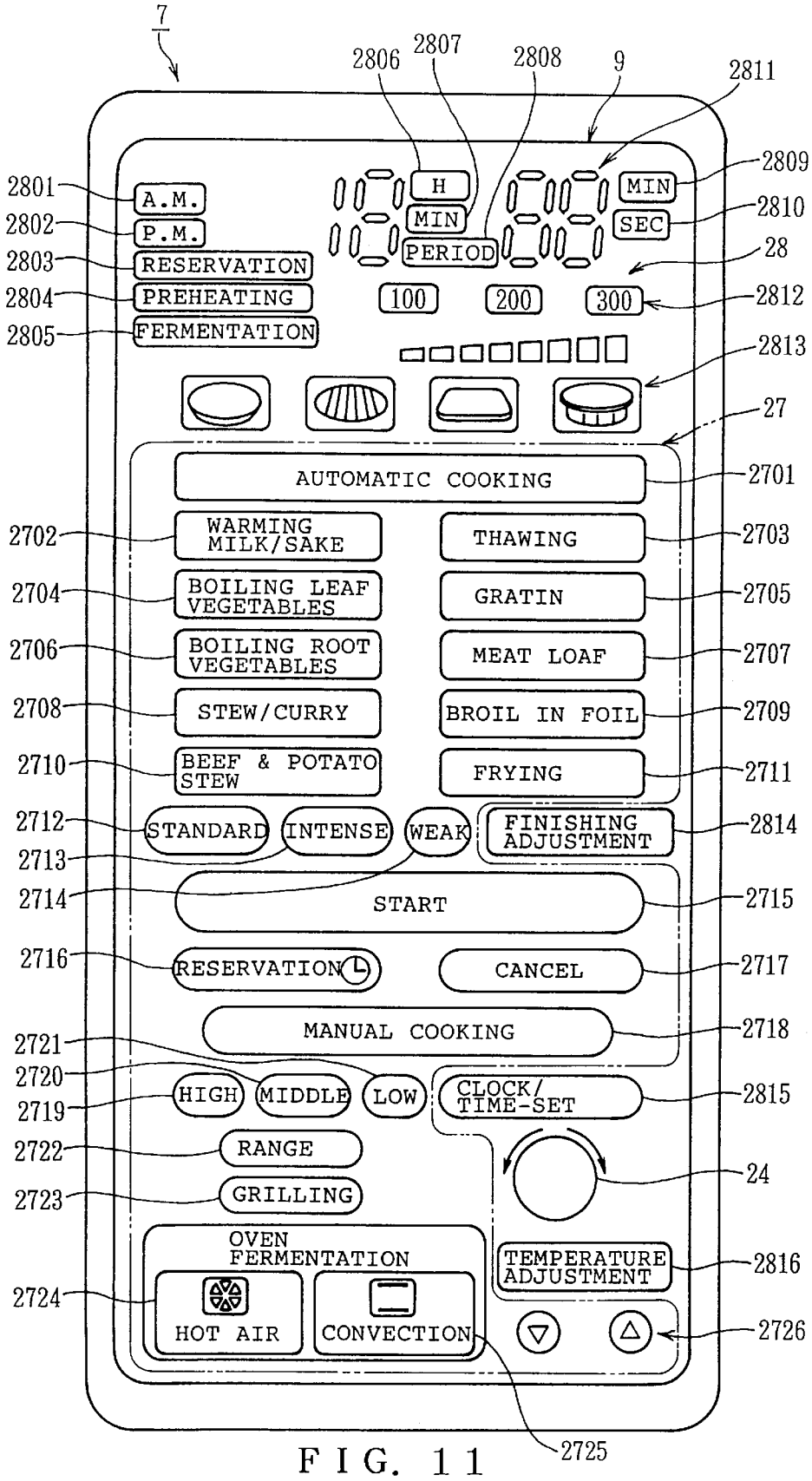
FIG. 11 is a front view of an operation section of the operation panel including various pieces of cooking information to be displayed in a microwave oven of a fourth embodiment in accordance with the present invention.

FIG. 11 illustrates a fourth embodiment of the present invention. The fourth embodiment provides a definite form of the operation section 7. The liquid crystal element subsection 9 of the operation section 7 has an advantage in measurements for waterproofing when the liquid crystal element subsection 9 has a smaller area of section, as described above. Accordingly, the liquid crystal element subsection 9 is formed into a one-piece construction and extends substantially over the entire operation section 7.

Referring to FIG. 11, an area of the liquid crystal element subsection 9 encompassed by the two-dot chain line includes a group 27 of operation keys having respective indicias or pieces of cooking information which can be viewed when the liquid crystal element subsection 9 is energized. The other area of the liquid crystal element subsection 9 includes a group 28 of alphanumeric display sections. The segments of the segmented transparent electrode 906 of the liquid crystal element subsection 9 correspond to the respective operation keys of the group 27 and the respective alphanumeric display sections of the group 28.

The operation key group 27 includes an AUTOMATIC COOKING key 2701, a WARMING MILK/SAKE key 2702, a THAWING key 2703, a BOILING LEAF VEGETABLES key 2704, a GRATIN key 2705, a BOILING ROOT VEGETABLES key 2706, a MEAT LOAF key 2707, a STEW/CURRY key 2708, a BROIL IN FOIL key 2709, a BEEF & POTATO STEW key 2710, a FRYING key 2711, a STANDARD key 2712, an INTENSE key 2713, a WEAK key 2714, a START key 2715, a RESERVATION key 2716, a CANCEL key 2717, a MANUAL COOKING key 2718, a HIGH key 2719, a MIDDLE key 2720, a LOW key 2721, a RANGE key 2722, a GRILLING key 2723, a HOT AIR key 2724, a CONVECTION key 2725, and a TEMPERATURE ADJUSTMENT key 2726. The alphanumeric display group 28 includes an A.M. display section 2801, a P.M. display section 2802, a RESERVATION display section 2803, a PREHEATING display section 2804, a FERMENTATION display section 2805, an HOUR display section 2806, a MINUTE display section 2807, a PERIOD display section 2808, a MINUTE display section 2809, a SECOND display section 2810, a numeral display section 2811, a set temperature display section 2812, a graphic cooking utensil display section 2813, a FINISHING ADJUSTMENT display section 2814, a CLOCK/TIME-SET display section 2815, a CLOCK/TIME-SET key 24, and a TEMPERATURE ADJUSTMENT display section 2816. The CLOCK/TIME-SET key 24 is shown in FIG. 8.

The control device 14 operates to apply voltage between the common transparent electrode 904 and all the segments of the segmented transparent electrode 906 when an electric power is supplied to the microwave oven. Since all the liquid crystal segments of the liquid crystal element subsection 9 are caused to permit light to pass therethrough, all the pieces of cooking information of the group 27 and all the pieces of cooking information of the group 28 are displayed on the liquid crystal element subsection 9 as are shown in FIG. 11. Accordingly, the user can confirm the operable keys when the electric power is supplied to the microwave oven.

Figure 12:
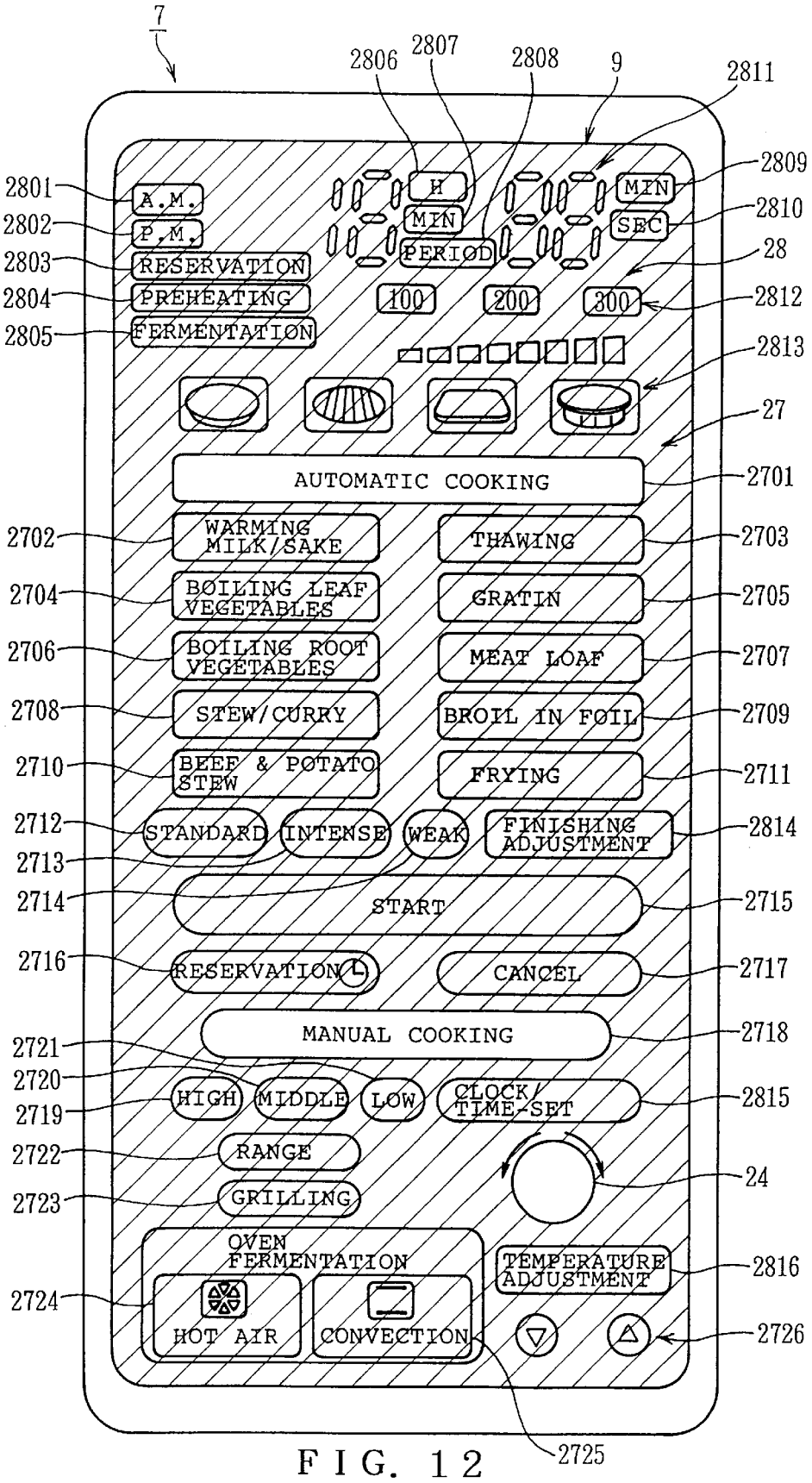
FIG. 12 is a view similar to FIG. 11, showing a fifth embodiment in accordance with the present invention.
Figure 13:
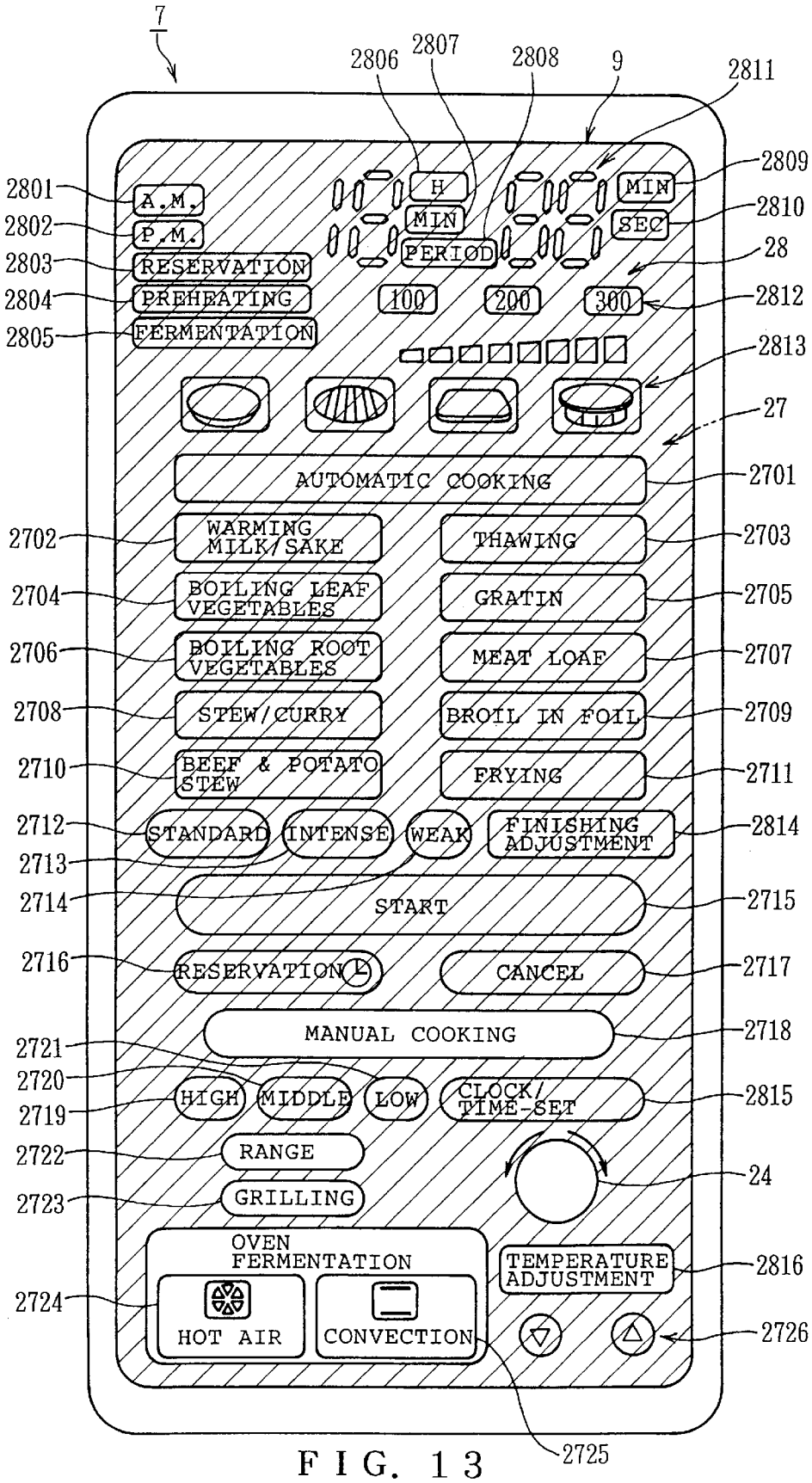
FIG. 13 is a view similar to FIG. 12, showing a different display mode.

FIG. 12 illustrates a fifth embodiment of the present invention. Identical or similar parts are labeled by the same reference numerals in the fifth embodiment as those in the fourth embodiment. The differences between the fourth and fifth embodiments will be described. One or more acceptable operation keys are prompted in the fifth embodiment. More specifically, the control device 14 operates to apply voltage between the common transparent electrode 904 and the segments of the segmented transparent electrode 906 corresponding to the subsequently acceptable operation keys. Accordingly, since only the liquid crystal segments to the electrodes of which the voltage is applied are caused to permit light to pass therethrough, the indicias corresponding to these segments are displayed on the liquid crystal element section 9, as are shown in FIG. 12. In the condition of FIG. 12, the operation keys and the display segments shown by oblique lines are in the light-untransmissible state while the AUTOMATIC COOKING key 2701 and the MANUAL COOKING key 2718 are in the light-transmissible state and accordingly acceptable. The user then depresses either one of these keys. When the MANUAL COOKING key 2718 is depressed, predetermined operation keys are rendered light-transmissible as shown in FIG. 13. That is, the HIGH key 2719, the MIDDLE key 2720, the LOW key 2721 and operation keys 2722 to 2725 and 2816 all required for setting a manual cooking mode are turned to the light-transmissible state. The user then operates these operation keys so that the cooking conditions for the manual cooking mode is reliably set in the microwave oven.

According to the fifth embodiment, the subsequently acceptable operation keys are displayed on the operation section 7 sequentially. Consequently, the microwave oven with high usability can be provided.

An initially acceptable operation key may be prompted when the electric power is supplied to the microwave oven. Thus, since the initially acceptable operation key can be confirmed by the user, the operation keys can be properly operated in the use of the microwave oven without user's embarrassment.

Furthermore, all the operation keys may be displayed and thereafter, the subsequently acceptable operation keys may be sequentially displayed. In such a case, the user can get information as to what kind of key-input cooking information is available and confirm subsequently acceptable operation keys. Consequently, the usability of the microwave oven can be further improved.

Figure 14:
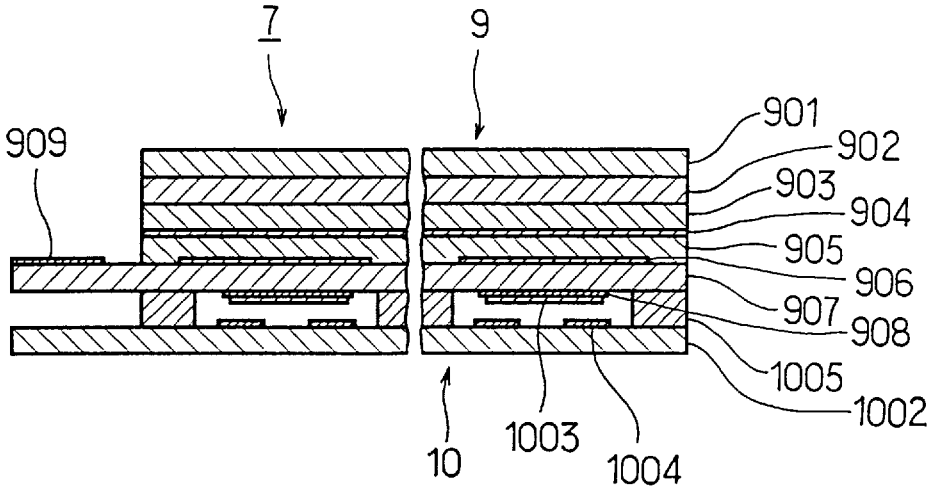
FIG. 14 is a view similar to FIG. 3, showing a sixth embodiment in accordance with the present invention.

FIG. 14 illustrates a sixth embodiment of the present invention. The membrane switch 10 is combined with the liquid crystal element subsection 9 in the first embodiment so that the operation section 7 is provided. In the sixth embodiment, the liquid crystal element subsection 9 and the membrane switch 10 are integrated. More specifically, the segmented electrode film 907 of the liquid crystal element section 9 also serves as a film for the membrane switch 10. The membrane electrodes 1003 of the membrane switch 10 are attached to the reflecting member 908 of the liquid crystal element subsection 9. Since the film of the membrane switch 10 is eliminated, the construction of the operation section 7 can be simplified and its manufacturing cost can be reduced.

Figure 15:
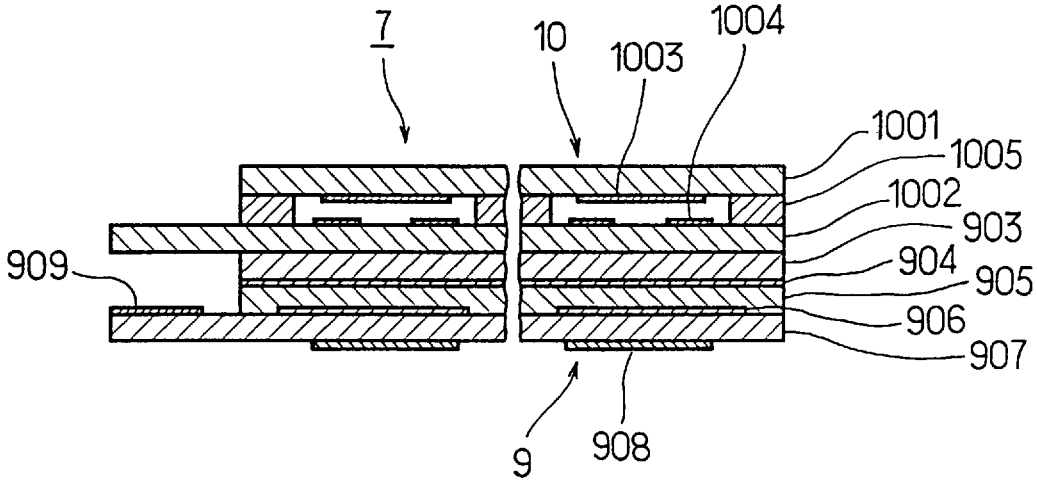
FIG. 15 is a view similar to FIG. 3, showing a seventh embodiment in accordance with the present invention.

FIG. 15 illustrates a seventh embodiment of the present invention. The membrane switch 10 is disposed on the back of the liquid crystal element subsection 9 in the first embodiment. In the seventh embodiment, the membrane switch 10 is disposed on the front of the liquid crystal element subsection 9. The films 1001 and 1002 of the membrane switch 10 are transparent. Each membrane electrode 1003 and each short pad 1004 are formed of transparent electrodes. The membrane switch 10 composed as described above is attached to the front of the liquid crystal element subsection 9. Since the membrane switch 10 has a function of a UV barrier cutting off ultraviolet rays, the UV barrier 902 employed in the first embodiment can be eliminated and accordingly, the manufacturing cost can be reduced.

Figure 16:
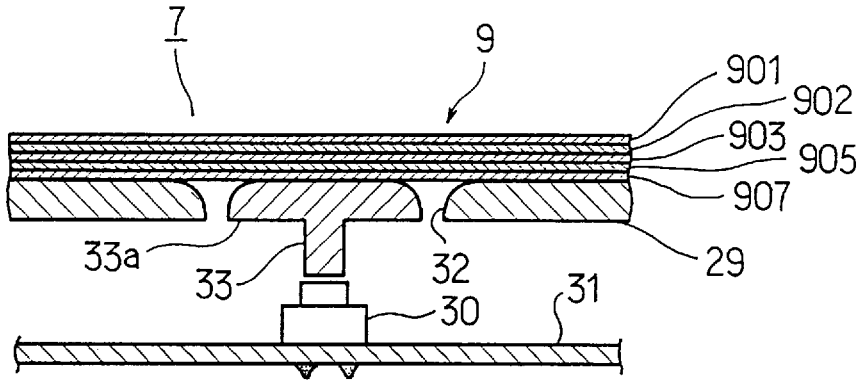
FIG. 16 is a view similar to FIG. 3, showing an eighth embodiment in accordance with the present invention.
Figure 17:
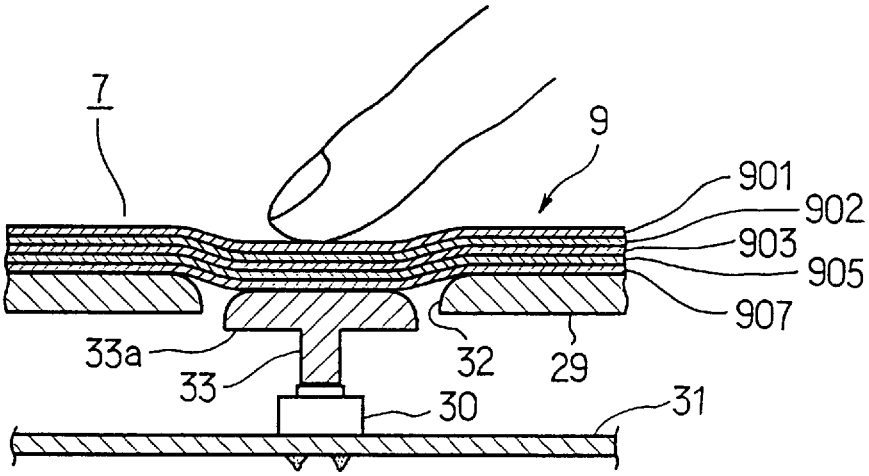
FIG. 17 is a view similar to FIG. 16, showing the depressed state of a liquid crystal element.

FIGS. 16 and 17 illustrate an eighth embodiment of the present invention. Although the membrane switch 10 is used as a switch subsection in the first embodiment, tact switches are used to compose the switch subsection in the eighth embodiment. The liquid crystal element subsection 9 is supported at its back side by a support member 29. A printed circuit board 31 on which tact switches 30 one of which is shown are mounted is disposed behind the support member 29. The tact switch 30 generally has a contact area smaller than each indicia portion of the indicia subsection. Accordingly, if the liquid crystal element subsection 9 is designed to be depressed so that the flexure thereof directly operates the tact switch 30, an amount of operating force transmitted to the tact switch 30 would become unstable depending upon a location of portion of the indicia subsection depressed by the user. In the embodiment, the support member 29 has a plurality of through holes 32, one of which is shown, corresponding to the indicias of the indicia subsection respectively. An actuating member 33 is disposed between the liquid crystal element subsection 9 and the tact switch 30 so that displacement of the indicia subsection caused by depression of the liquid crystal element subsection 9 is transmitted via the actuating member 33 to the tact switch 30. The actuating member 33 includes an upper large-diameter portion brought into contact with the liquid crystal element subsection 9 and a lower small diameter portion in contact with the tact switch 30. Thus, the actuating member 33 is formed so as to have a larger contact area with the liquid crystal element subsection 9 than one with the tact switch 30.

The hole 32 has a peripheral edge chamfered or rounded, as is shown in FIG. 16. Consequently, a large stress is prevented from being applied to a portion of the liquid crystal element subsection 9 abutting against the support member 29 when the liquid crystal element subsection 9 is depressed as shown in FIG. 17. Furthermore, the peripheral edge 33*a* of the upper portion of the actuating member 33 is also chamfered or rounded as shown in FIG. 16. Consequently, a large stress is prevented from being applied to a portion of the liquid crystal element subsection 9 abutting against the actuating member 33 when the liquid crystal element subsection 9 is depressed as shown in FIG. 17. Thus, since the liquid crystal element subsection 9 is prevented from being damaged by the support member 29 or the actuating member 33, the operation section 7 with an improved durability can be provided.

According to the eighth embodiment, the displacement of the indicia subsection can be stably transmitted via the actuating member 33 to the tact switch 30 even when an off-centered portion of each indicia portion of the indicia subsection is depressed. Consequently, the cooking conditions can be reliably set.

Furthermore, the switch subsection can be rendered thinner when the membrane switch is employed. However, the basic construction of the membrane switch requires a relatively high cost. Accordingly, in the case where the number of operation keys is small, the cost of the switch subsection can be reduced when the tact switches are employed instead of the membrane switch. Additionally, the tact switch clicks when depressed, thereby providing a better operability.

Figure 18:
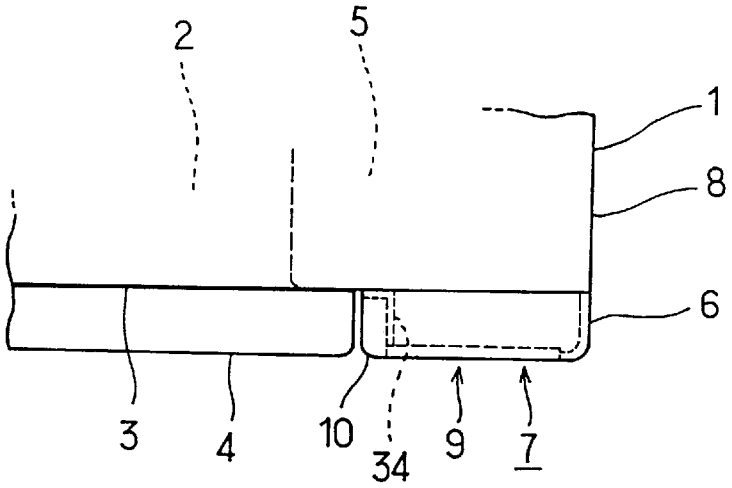
FIG. 18 is a view similar to FIG. 2, showing a ninth embodiment in accordance with the present invention.

FIG. 18 illustrates a ninth embodiment of the present invention. The ninth embodiment provides a construction for preventing the operation section 7 from being adversely affected by microwaves generated by the magnetron 19. More specifically, in a range cooking mode by the microwave oven, there is a possibility that even when the front opening of the heating chamber 2 is closed by the door 4, a very small amount of microwave energy supplied from the magnetron 19 into the heating chamber 2 may leak out of the heating chamber 2 through a small gap between the heating chamber 2 and the door 4. If the microwave energy should leak through the gap between the heating chamber 2 and the door 4, the liquid crystal element subsection 9 would be adversely affected into malfunction.

To solve the above-described problem, the ninth embodiment provides a radio wave shield 34 interposed between the panel frame 13 and the side face of the operation section 7 for intercepting the microwaves leaked through the gap between the heating chamber 2 and the door 4. Consequently, if microwaves should leak through the gap between the heating chamber 2 and the door 4, the operation section 7 could be prevented from malfunction. Furthermore, all lead wires 12 of the operation section 7 are extended out of its end opposite to the heating chamber 2, as shown in FIG. 6. This construction is advantageous not only in prevention of adverse affection of heat from the heating chamber 2 upon the lead wires 12 but also in prevention of malfunction of the operation section 7 by the microwaves from the heating chamber 2.

The temperature in the heating chamber 2 is increased during heating. Particularly in the microwave oven with oven cooking and grilling functions, the temperature in the heating chamber 2 is typically increased during an oven or grilling cooking mode. In this case, the whole microwave oven is subjected to heat from the heating chamber 2 such that the temperature of the whole microwave oven is increased. Consequently, there is a possibility that an increase in the temperature of the operation section 7 would lower the displaying function of the liquid crystal element subsection 9. In particular, the temperature of an upper one third of the microwave oven or an upper one third of the panel section 6 is increased high.

Figure 19:
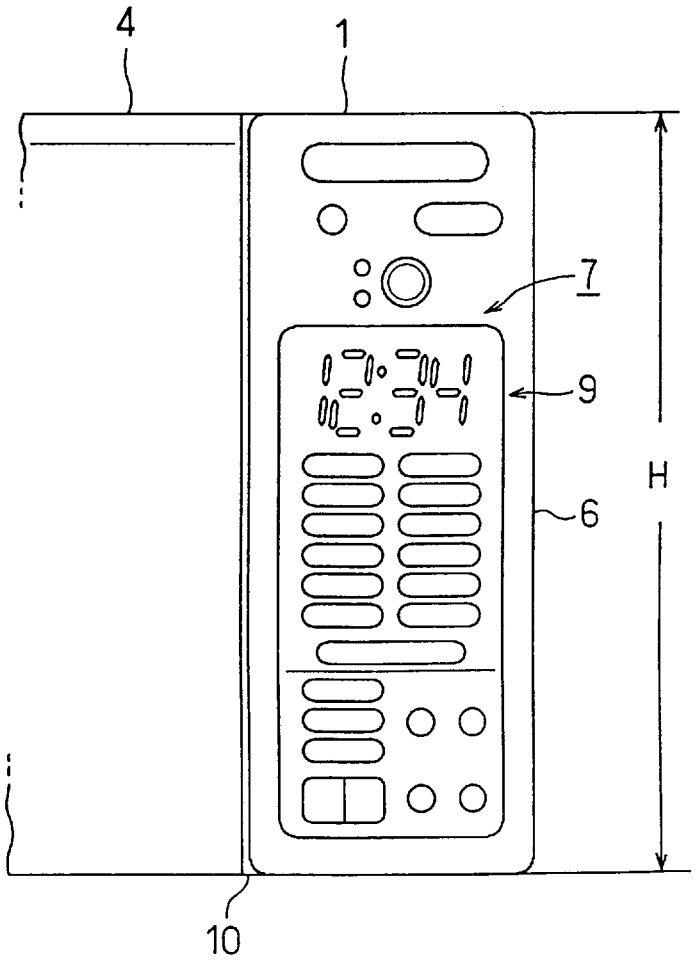
FIG. 19 is a front view of an operation panel section of a microwave oven of a tenth embodiment in accordance with the present invention.

A tenth embodiment of the present invention copes with the above-described problem. Referring to FIG. 19, the liquid crystal element subsection 9 is preferably disposed on the panel section 6 so as to vertically extend by two thirds of the height H of the panel section 6 from the lower end thereof.

Figure 20:
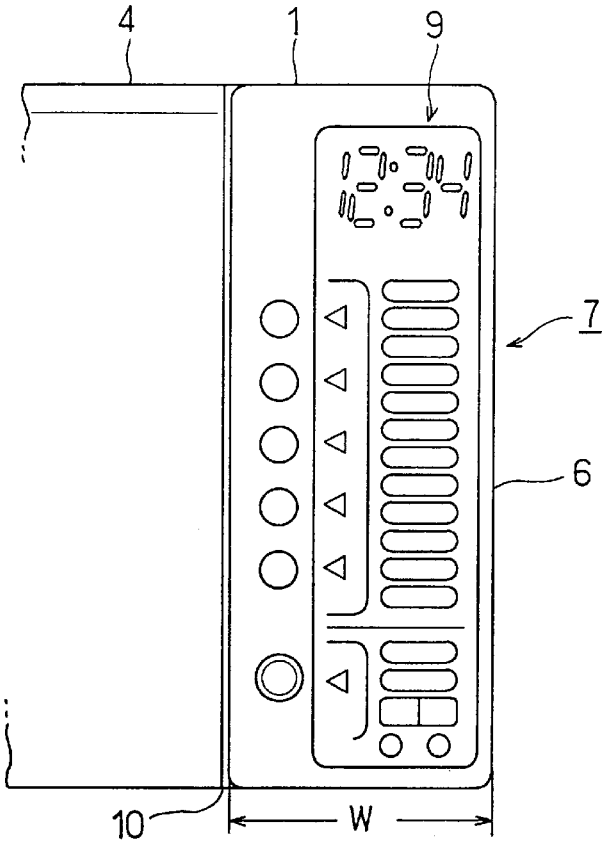
FIG. 20 is a view similar to FIG. 19, showing an eleventh embodiment in accordance with the present invention.

Furthermore, the temperature of the operation section 7 is increased faster as it approaches the heating chamber 2. To cope with this problem, an eleventh embodiment of the present invention provides a disposition of the liquid crystal element subsection 9 as shown in FIG. 20. That is, the liquid crystal element subsection 9 is preferably disposed on the panel section 6 so as to transversely extend toward the heating chamber 2 by two-thirds of the width of the panel section 6 from the outer side face of the microwave oven. In other words, the liquid crystal element subsection 9 is preferably disposed on the panel section 6 to be one-sided away from the heating chamber 2.

Figure 21:
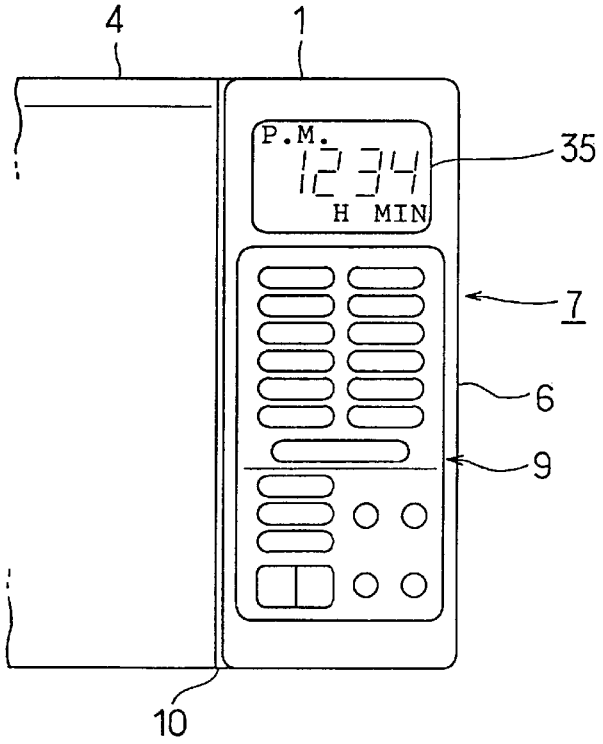
FIG. 21 is a view similar to FIG. 20, showing a twelfth embodiment in accordance with the present invention.

FIG. 21 illustrates a twelfth embodiment of the present invention. A fluorescent character display tube 35 is disposed on the upper portion of the panel section 6. The fluorescent character display tube 35 is adapted to display the current time thereon, for example. Since the fluorescent character display tube 35 can be used in an atmosphere of high temperature, the upper portion of the panel section 6 whose temperature is increased high can be effectively utilized.

The present invention should not be limited to the above-described embodiments. In one modified form, a ceramic or mica plate may be disposed on the side face of the operation section 7 adjacent to the heating chamber 2 to serve as the heat shield, and a heat-resisting paint may be applied to the panel frame 13. In another modified form, the operation section 7 may be provided on the outer surface of the door 4. Furthermore, the present invention may be applied to electric toaster ovens.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A heating apparatus comprising:

a heater;

a heating chamber provided for accommodating food to be heated by the heater and having a front opening;

a door for closing and opening the front opening of the heating chamber;

an operation panel including:

a panel section disposed to be adjacent to the door; and an operation section provided on the panel section and having a function of displaying a plurality of pieces of cooking information, the operation section including:

a liquid crystal element subsection comprising a nematic curvilinear aligned phase (NCAP) liquid crystal permitting light to pass therethrough when voltage is applied thereto;

an indicia subsection disposed to be laid on the liquid crystal element subsection and having a plurality of indicias corresponding to the pieces of cooking information, respectively; and a switch subsection including a plurality of switches provided to correspond to the indicias of the indicia subsection, respectively; and a heat shield provided between the door and the operation section for restricting heat transfer from the door to the operation section of the operation panel.

2. A heating apparatus according to claim 1, wherein the operation section projects ahead of the front opening of the heating chamber and has a front surface approximately planar with a front surface of the door.

3. A heating apparatus according to claim 1, wherein the liquid crystal element subsection of the operation section is a single plate extending over substantially an entire surface of the panel section.

4. A heating apparatus according to claim 1, wherein the liquid crystal element subsection of the operation section is a panel having substantially no holes therein and a cut face in an outer peripheral end face thereof.

5. A heating apparatus according to claim 1, wherein the liquid crystal element subsection of the operation section has an end face which is waterproofed.

6. A heating apparatus according to claim 1, wherein the operation section includes a protrusion protruding from a front face thereof, and the liquid crystal element subsection of the operation section has a hole encompassing the protrusion and has an inner peripheral end face which is waterproofed.

7. A heating apparatus according to claim 1, wherein the indicia subsection of the operation section comprises a first element reflecting light having passed through the liquid crystal element subsection.

8. A heating apparatus according to claim 1, wherein the indicia subsection of the operation section comprises a first element permitting light to pass through the liquid crystal element subsection.

9. A heating apparatus according to claim 8, further comprising a backlight provided behind the second element.

10. A heating apparatus according to claim 9, further comprising an oven light for illuminating the interior of the heating chamber, and wherein the oven light is adapted to also serve as the backlight.

11. A heating apparatus according to claim 1, wherein the indicia subsection of the operation section comprises a first element reflecting light having passed through the liquid crystal element subsection and a second element permitting light to pass through the liquid crystal element subsection.

12. A heating apparatus according to claim 11, further comprising a backlight provided behind the second element.

13. A heating apparatus according to claim 11, further comprising an oven light for illuminating the interior of the heating chamber, and wherein the oven light is adapted to also serve as the backlight.

14. A heating apparatus according to claim 3, wherein the switch subsection of the operation section includes a plurality of switches all of which correspond to the indicias of the indicia subsection, respectively.

15. A heating apparatus according to claim 1, wherein the liquid crystal element subsection of the operation section includes a plurality of segments corresponding to the indicias of the indicia subsection, respectively, and the liquid crystal element subsection is controlled so that all the segments thereof corresponding to the respective indicias of the indicia subsection are each turned to a light transmissible state when electric power is supplied to the apparatus.

16. A heating apparatus according to claim 1, wherein the liquid crystal element subsection of the operation section includes a plurality of segments corresponding to the indicias of the indicia subsection, respectively, and the liquid crystal element subsection is controlled so that one or more segments thereof corresponding to the acceptable switches of the switch subsection are each turned to a light transmissible state after one of the other switches of the switch subsection has been operated.

17. A heating apparatus according to claim 1, wherein the liquid crystal element subsection of the operation section includes a plurality of segments corresponding to the indicias of the indicia subsection, respectively, and the liquid crystal element subsection is controlled so that one or more segments thereof corresponding to the acceptable switches of the switch subsection are each turned to a light transmissible state when electric power is supplied to the apparatus.

18. A heating apparatus according to claim 1, wherein the liquid crystal element subsection of the operation section includes a plurality of segments corresponding to the indicias of the indicia subsection, respectively, and the liquid crystal element subsection is controlled so that all the segments thereof corresponding to the respective indicias of the indicia subsection are each turned to a light transmissible state when electric power is supplied to the apparatus and subsequently, only one or more segments thereof corresponding to the acceptable switches of the switch subsection are each turned to a light transmissible state.

19. A heating apparatus according to claim 1, wherein the switch subsection of the operation section comprises a membrane switch including films and electrodes disposed between the films.

20. A heating apparatus according to claim 19, wherein the membrane switch includes a part of the liquid crystal element subsection as a component thereof.

21. A heating apparatus according to claim 19, wherein the membrane switch further includes contacts, each of said contacts being formed of a transparent material, wherein each film of the membrane switch is formed of a transparent material, and wherein the membrane switch is disposed at a front surface side of the liquid crystal element subsection.

22. A heating apparatus according to claim 1, wherein the switch subsection of the operation section comprises a plurality of tact switches.

23. A heating apparatus according to claim 22, wherein the switch subsection of the operation section further comprises a plurality of actuating members disposed between the liquid crystal element subsection of the operation section and the respective tact switches, each actuating member being displaced in response to depression applied to the liquid crystal element subsection, thereby actuating the corresponding tact switch, wherein each actuating member has a first contact portion brought into contact with the liquid crystal element subsection and a second contact portion brought into contact with the corresponding tact switch, and wherein the first contact portion of each actuating member has a larger area than the second contact portion thereof.

24. A heating apparatus according to claim 23, wherein the first contact portion of the actuating member has a rounded peripheral edge.

25. A heating apparatus according to claim 23, wherein the operation section includes a support member supporting the liquid crystal element subsection and having a plurality of through holes through which the actuating members are disposed respectively, each through hole having a rounded peripheral edge at a side thereof in contact with the liquid crystal element subsection.

26. A heating apparatus according to claim 23, wherein the indicias of the indicia subsection of the operation section are formed on the first contact portions of the actuating members, respectively.

27. A heating apparatus according to claim 1, further comprising a radio wave shield provided between the operation section and the door, and wherein the heater comprises a magnetron for supplying microwaves to the heating chamber.

28. A heating apparatus according to claim 1, wherein the liquid crystal element subsection of the operation section has a surface formed of a material with a flame resistance at or above UL flame resistance grade 94-VO.

29. A heating apparatus according to claim 1, wherein the liquid crystal element subsection of the operation section is disposed on the panel section so as to extend in a range of two-thirds of the height of the panel section from a lower end thereof.

30. A heating apparatus according to claim 29, wherein the switch subsection of the operation section comprises a membrane switch including films and electrodes disposed between the films.

31. A heating apparatus according to claim 30, wherein the membrane switch includes a part of the liquid crystal element subsection as a component thereof.

32. A heating apparatus according to claim 30, wherein the membrane switch further includes contacts, each of said contacts being formed of a transparent material, wherein each film of the membrane switch is formed of a transparent material, and wherein the membrane switch is disposed at a front surface side of the liquid crystal element subsection.

33. A heating apparatus according to claim 1, wherein the liquid crystal element subsection of the operation section is disposed on the panel section so as to extend in a range of two-thirds of the width of the panel section from an end of the apparatus opposite the heating chamber.

34. A heating apparatus according to claim 1, wherein the liquid crystal element subsection of the operation section is disposed on the panel section so that a distance between an end thereof at a side of the heating chamber and an end of the panel section at the heating chamber side is longer than a distance between an end thereof at a side opposite the heating chamber and an end of the panel section at the side opposite the heating chamber.

35. A heating apparatus according to claim 1, wherein the panel section includes a display element disposed on an upper portion thereof and wherein the liquid crystal element subsection is disposed on the panel section to be located lower than the display element.

36. A heating apparatus according to claim 1, wherein the liquid crystal element subsection of the operation section has one or more lead wires extending out of an end thereof opposite to the heating chamber.

* * * * *